US005613868A

United States Patent [19]

Ohsumi et al.

[11] Patent Number: 5,613,868

[45] Date of Patent: Mar. 25, 1997

[54] WATERPROOF CONNECTOR

[75] Inventors: Hideki Ohsumi; Yoshinori Tomita, both of Shizuoka, Japan

[73] Assignee: Yazaki Corporation, Tokyo, Japan

[21] Appl. No.: 443,459

[22] Filed: May 18, 1995

[30] Foreign Application Priority Data

May 23, 1994 [JP] Japan ..... 6-108014

[51] Int. Cl.[6] ..... H01R 13/52

[52] U.S. Cl. ..... 439/275; 439/279; 439/587

[58] Field of Search ..... 439/274, 275, 439/279, 587

[56] References Cited

U.S. PATENT DOCUMENTS

| | | | |
|---|---|---|---|
| 4,214,802 | 7/1980 | Otani et al. | 439/275 |
| 4,614,390 | 9/1986 | Baker | 439/275 |
| 4,681,691 | 7/1987 | Schriver, Jr. | 439/274 |
| 4,713,021 | 12/1987 | Kobler | 439/275 |
| 4,998,896 | 3/1991 | Lundergan | 439/274 |
| 5,145,410 | 9/1992 | Maejima et al. | 439/274 |

FOREIGN PATENT DOCUMENTS

| | | | |
|---|---|---|---|
| 1146478 | 10/1989 | Japan | H01R 13/52 |
| 353470 | 3/1991 | Japan | H01R 13/52 |

*Primary Examiner*—Stephen P. Garbe
*Attorney, Agent, or Firm*—Sughrue, Mion, Zinn, Macpeak & Seas

[57] ABSTRACT

A waterproof connector includes a connector housing having a plurality of terminal receiving chambers, a waterproof plug, and a waterproof plug holder. The waterproof plug and the waterproof plug holder have a plurality of insertion holes corresponding respectively to the terminal receiving chambers. The waterproof plug and the waterproof plug holder are connected to the connector housing in a two-stage manner, that is, in a completely-retained condition and a provisionally-retained condition. In the provisionally-retained condition, an annular sealing rib, formed on an inner surface of each of the insertion holes, is compressed between the connector housing and the waterproof plug holder to expand the insertion hole.

3 Claims, 4 Drawing Sheets

WATERPROOF CONNECTOR

BACKGROUND OF THE INVENTION

The present invention relates to a waterproof connector used mainly for connecting a wire harness in an automobile.

In FIG. 6, a mat-like waterproof plug b is fitted on a rear end of a connector housing a having a plurality of terminal receiving chambers $a_1$, and is fixed by a waterproof plug holder c. Each terminal d, having a wire e connected thereto, is inserted into the corresponding terminal receiving chamber $a_1$ through a corresponding through hole $c_1$ (formed through the waterproof plug holder c) and a corresponding insertion hole $b_1$ formed through the waterproof plug b, and is retained by known retaining means. At this time, the terminal d is press-fitted into the insertion hole $b_1$ in the waterproof plug b to pass therethrough while expanding this insertion hole $b_1$, and therefore there is encountered a problem that considerable labor is required for this insertion operation. Another problem is that when inserting and withdrawing the terminal d, the inner surface of the insertion hole $b_1$ is damaged, thus lowering a sealing effect.

On the other hand, in a construction shown in FIGS. 7(A) and 7(B), a waterproof plug b' is supported by a waterproof plug holder c' in a connector housing a' in a non-compressed condition and provisionally retained condition. In this condition, a terminal d', having a wire e' connected thereto, is inserted into a terminal receiving chamber $a_1'$ through a relatively-wide insertion hole $b_1'$ (see FIG. 7(A)), and then the waterproof plug holder c' is forced into a completely-retained condition to compress the waterproof plug b', so that an annular rib $b_2'$ defining the insertion hole $b_1'$ is deformed to be brought into press contact with the peripheral surface of the wire e', thereby enhancing the waterproof effect (see FIG. 7(B)). In this construction, damage to the waterproof plug b' can be avoided when inserting the terminal d'; however, since the whole of the waterproof plug b' is held in a compressed condition for a long period of time, there is encountered a drawback that elasticity of the waterproof plug is lost upon application of heat, so that the waterproof plug fails to be restored into its original shape.

SUMMARY OF THE INVENTION

The present invention has been made in view of the above problems, and an object of the invention is to provide a construction in which when inserting and withdrawing terminals, a waterproof plug is compressed to cause insertion holes to be expanded, thereby allowing the terminals to easily pass through the respective insertion holes without damaging these holes, and also the waterproof plug is locally compressed to enhance a waterproof effect thereof while maintaining elasticity of the waterproof plug.

The above object has been achieved by a waterproof connector of the invention which comprises a connector housing having a plurality of terminal receiving chambers, a waterproof plug, and a waterproof plug holder, the waterproof plug and the waterproof plug holder having a plurality of insertion holes corresponding respectively to the terminal receiving chambers; wherein the waterproof plug and the waterproof plug holder are connected to the connector housing in a two-stage manner, that is, in a completely-retained condition and a provisionally-retained condition. In the provisionally-retained condition, an annular sealing rib, formed on an inner surface of each of the insertion holes, is compressed between the connector housing and the waterproof plug holder to expand the insertion hole.

In the above construction, a compressed tapering surface is formed on the annular sealing rib whereas a compressing tapering surface is formed on the connector housing so as to face the compressed tapering surface, wherein in the provisionally-retained condition, the compressing tapering surface is held in compressive contact with the associated compressed tapering surface.

In the provisionally-retained condition in which each insertion hole in the waterproof plug is expanded by compression, a metal terminal connected to a wire is passed through the corresponding insertion hole, and in the completely-retained condition the annular sealing rib on the inner surface of the insertion hole is restored to be held in intimate contact with the outer periphery of the wire.

DETAILED DESCRIPTION OF THE INVENTION

Figure 1:
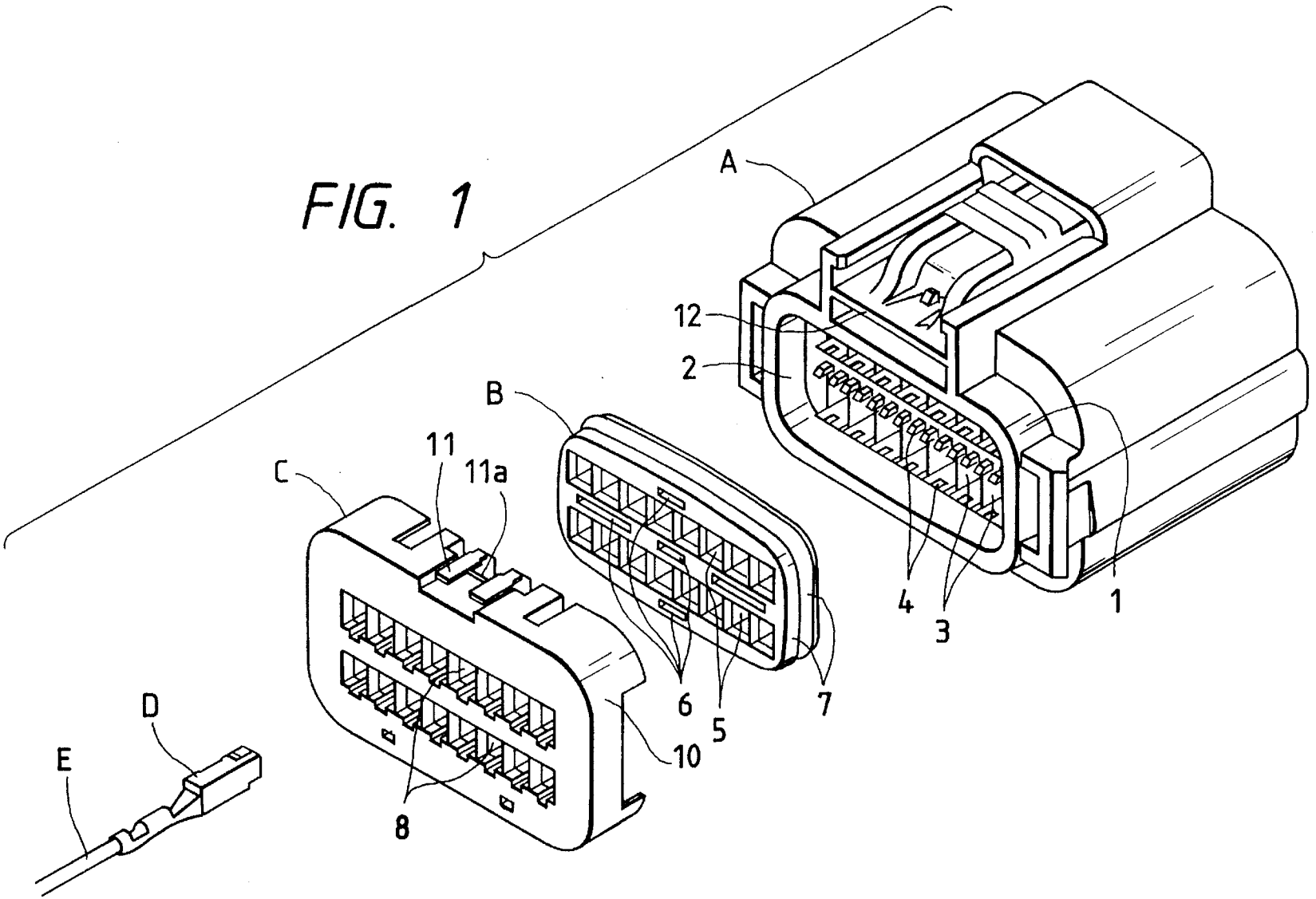
FIG. 1 is an exploded, perspective view of a connector of the present invention.

In FIG. 1, reference character A denotes a waterproof connector housing of a synthetic resin, reference character B a mat-like waterproof plug of rubber, reference character C a waterproof plug holder of a synthetic resin, and reference character D a terminal beforehand connected to a wire E.

Figure 2:
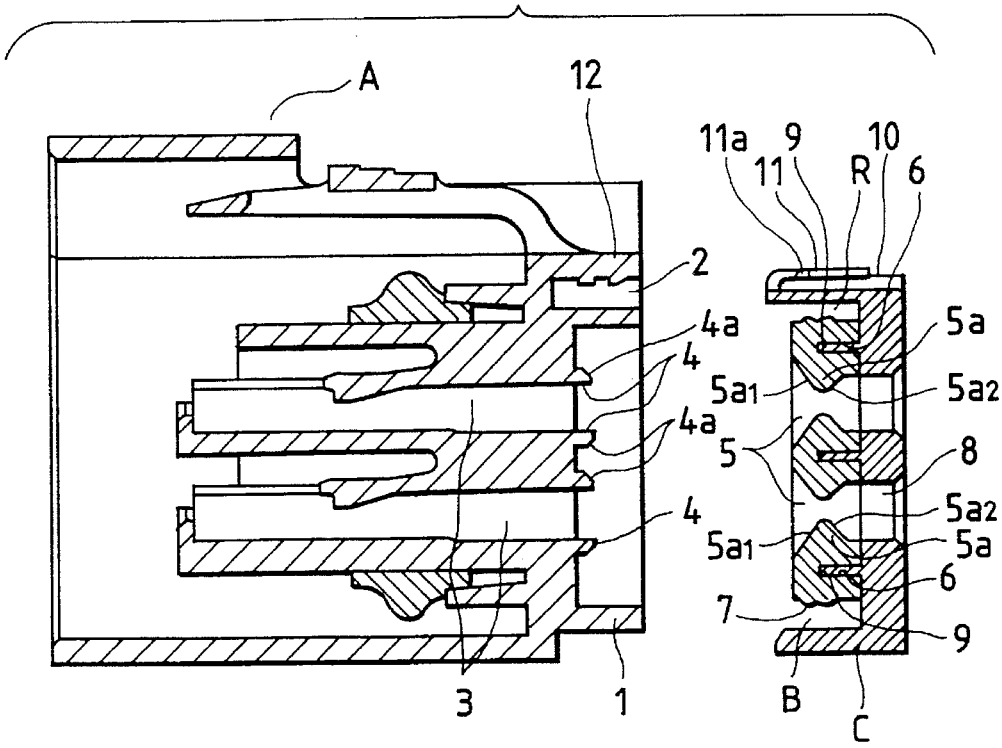
FIG. 2 is a cross-sectional view showing a condition in which a waterproof plug and a waterproof plug holder are separated from a connector housing.

A mounting frame portion 1 for the waterproof plug holder C is formed at a rear end of the connector housing A, and a waterproof plug-fitting portion 2, which is open rearwardly, is formed in the mounting frame portion 1. A plurality of terminal receiving chambers 3, arranged in a pair of upper and lower rows, are open in the waterproof plug-fitting portion 2, and a pair of waterproof plug-compressing projections 4, which are directed rearwardly, are formed respectively on upper and lower portions of each terminal receiving chamber 3 at the rear end thereof. A compressing tapering (slanting) surface 4*a* is formed on each waterproof plug-compressing projection 4 (see FIG. 2).

A plurality of insertion holes 5 are formed through the mat-like waterproof plug B, and correspond to the terminal receiving chambers 3, respectively. Connecting holes 6 for the waterproof holder C are formed in upper, lower and intermediate walls of the plug B, and annular ribs 7 for sealing purposes are formed on the outer periphery of the plug B. An annular sealing rib 5*a* is formed on an inner surface of each insertion hole 5. The annular sealing rib 5*a* is of a triangular cross-section having tapering surfaces $5a_1$ and $5a_2$ formed respectively at opposite sides thereof. The compressed tapering surface $5a_1$, facing the compressing tapering surface 4*a* of the connector housing A, is larger in size than the other tapering surface $5a_2$ (see FIG. 2).

The waterproof plug holder C has through holes 8 which correspond respectively to the insertion holes 5 in the waterproof plug B, and are larger than the insertion holes 5. Connecting projections 9, corresponding respectively to the connecting holes 6 in the waterproof plug B, are formed on the inner side of the plug holder C. By press-fitting the connecting projections 9 respectively into the connecting holes 6, the waterproof plug B and the waterproof plug holder C are beforehand connected together, with the insertion holes 5 coincident respectively with the through holes 8, and an annular chamber R for receiving the mounting frame portion 1 of the connector housing A is formed between an inner surface of a peripheral wall 10 of the waterproof plug holder C and the outer peripheral surface of the waterproof plug B.

An elastic retaining piece portion 11 of the cantilever type is formed on an upper portion of the peripheral wall 10 of the waterproof plug holder C, and a retaining portion 11*a* thereof is engageable with a completely-retaining portion 12*a* and a provisionally-retaining portion 12*b* which are formed on an inner surface of an engagement portion 12 of the connector housing A (see FIG. 5).

The waterproof plug B and the waterproof plug holder C may be formed integrally with each other by molding.

Figure 3:
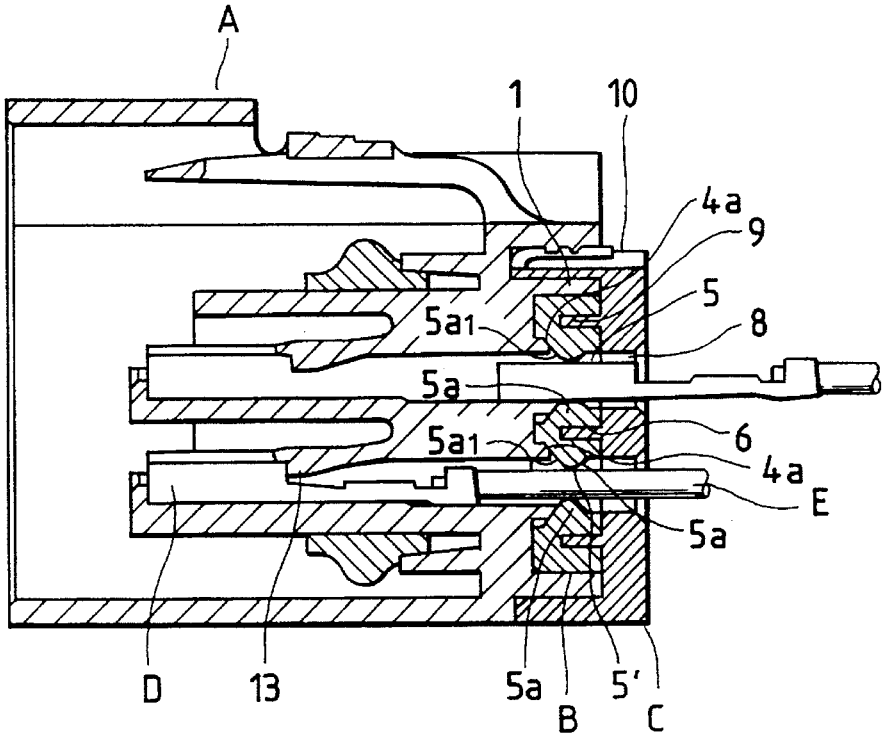
FIG. 3 is a cross-sectional view showing a condition in which the waterproof plug and the waterproof plug holder are provisionally retained in the connector housing.
Figure 5A:
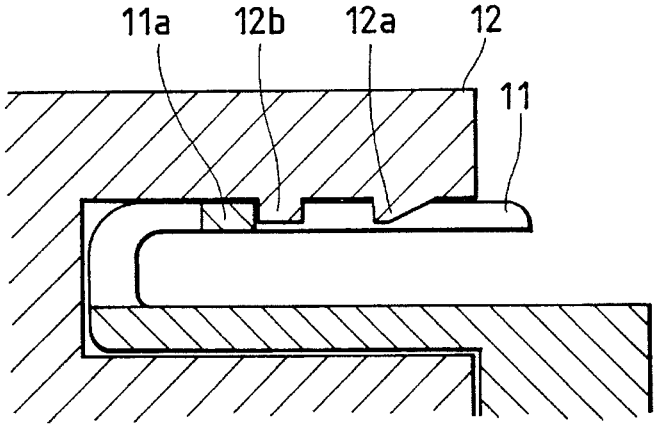
FIG. 5(A) is a view showing a retaining mechanism in the provisionally-retained condition.

The waterproof plug B and the waterproof plug holder C are beforehand set on the connector housing A in a provisionally-retained condition (see FIGS. 3 and 5(A)), and in this condition the compressing tapering surfaces 4*a* of each of waterproof plug-compressing projections 4 at the rear end of the connector housing A compress the compressed tapering surface $5a_1$ of the associated annular rib 5*a* of the waterproof plug B to hold the associated insertion hole 5 in an expanded condition. Therefore, the terminal D can be easily inserted into the associated terminal receiving chamber 3 through the associated insertion hole 5, and the terminal is retained by an elastic retaining piece portion 13.

Figure 4:
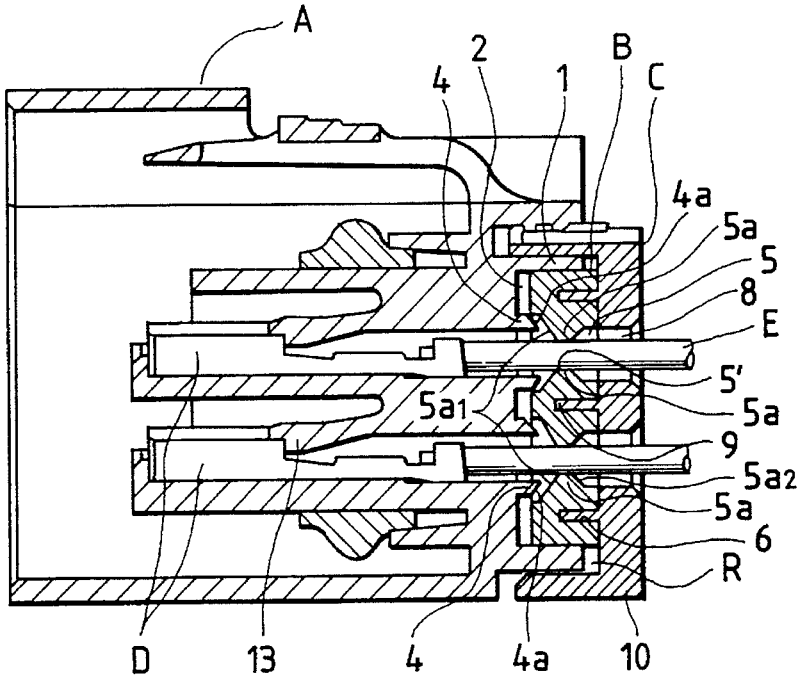
FIG. 4 is a cross-sectional view showing a condition in which the waterproof plug and the waterproof plug holder are completely retained in the connector housing.
Figure 5B:
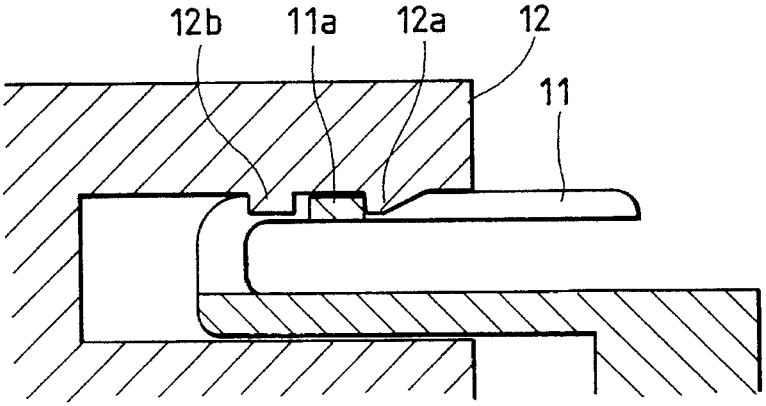
FIG. 5(B) is a view showing the retaining mechanism in the completely-retained condition.
Figure 6:
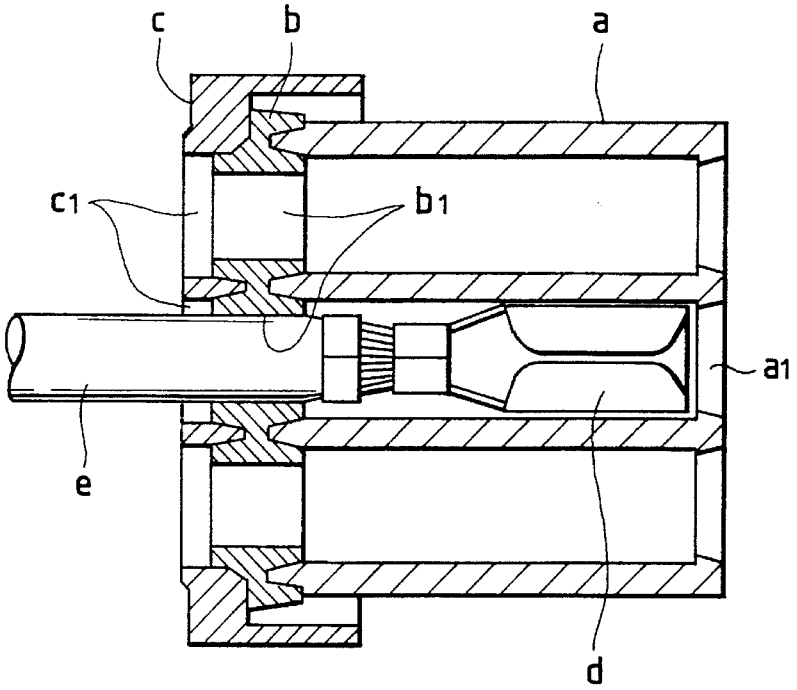
FIG. 6 PRIOR ART
FIG. 6 is a cross-sectional view of a conventional construction.
Figure 7A:
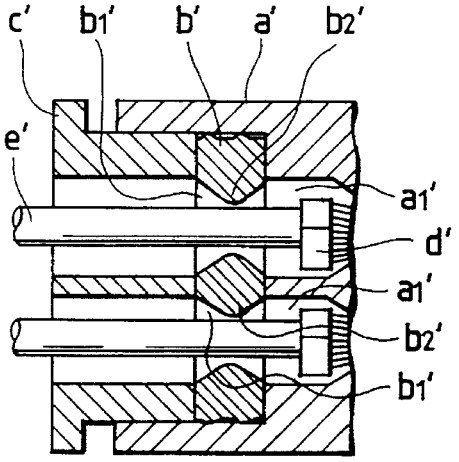
FIG. 7(A) PRIOR ART
FIG. 7(A) is a cross-sectional view of another conventional construction in a provisionally-retained condition.
Figure 7B:
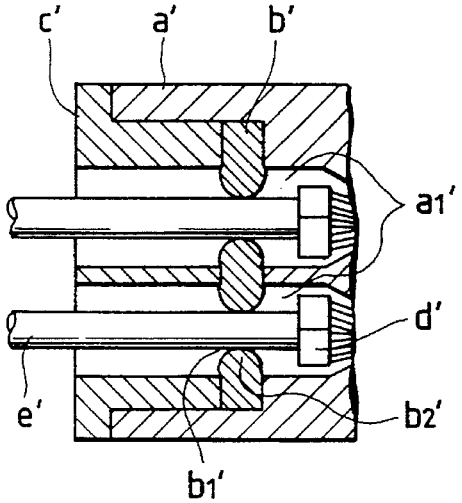
FIG. 7(B) PRIOR ART
FIG. 7(B) is a cross-sectional view of the conventional construction of FIG. 7(A) in a completely-retained condition.

After the insertion of the terminal D is completed, the waterproof plug holder C is pulled back into the completely-retained position (see FIGS. 4 and 5(B)). In this condition, since the waterproof plug-compressing projections 4 do not compress the annular ribs 5*a*, an apex portion 5' of each annular rib 5*a* is restored to narrow the insertion hole 5, and is held in intimate contact with the outer peripheral surface of the wire E, thus fully achieving the sealing effect.

When it becomes necessary to remove the terminal D, the waterproof plug holder C and the waterproof plug B are forced into the provisionally-retained position. In this case, since the waterproof plug B has been compressed locally, that is, only at the annular ribs 5*a*, the overall elasticity of the waterproof plug B is not lost.

As described above, the connector of the present invention comprises the connector housing having the plurality of terminal receiving chambers, the waterproof plug, and the waterproof plug holder, the waterproof plug and the waterproof plug holder having the plurality of insertion holes corresponding respectively to the terminal receiving chambers. The waterproof plug and the waterproof plug holder are connected to the connector housing in a two-stage manner, that is, in the completely-retained condition and the provisionally-retained condition. In the provisionally-retained condition, the annular sealing rib, formed on the inner surface of each of the insertion holes, is compressed between the connector housing and the waterproof plug holder to expand the insertion hole. With this construction, the terminal and the associated wire can be easily passed through the waterproof plug, and besides this plug has an enhanced sealing effect. In the provisionally-retained condition before the connector is used, the waterproof plug is compressed locally, that is, mainly at the annular sealing ribs at the insertion holes, and therefore the overall elasticity of the waterproof plug is not deteriorated, and hence this plug is durable.

What is claimed is:

1. A waterproof connector, comprising:

a connector housing having a plurality of terminal receiving chambers;

a waterproof plug having a plurality of insertion holes corresponding respectively to said terminal receiving chambers and an annular sealing rib formed on an inner surface of each of said insertion holes; and a waterproof plug holder connected to said waterproof plug, said waterproof plug holder having a plurality of insertion holes corresponding respectively to said terminal receiving chambers;

wherein said waterproof plug and said waterproof plug holder are configured to be connected to said connector housing in a completely-retained condition and a provisionally-retained condition; and in said provisionally-retained condition, said connector housing locally compresses said annular sealing rib between said connector housing and said waterproof plug holder to expand said insertion hole of said waterproof plug.

2. A waterproof connector according to claim 1, wherein said annular sealing rib has a compressed tapering surface and said connecting housing has a compressing tapering surface so as to face said compressed tapering surface, and wherein in said provisionally-retained condition, said compressing tapering surface compresses said compressed tapering surface.

3. A waterproof connector according to claim 2, wherein said compressing tapering surface is formed on a projection formed at a rear end of each of said terminal receiving chambers.

* * * * *